US005641314A

United States Patent [19]

Broschard, III et al.

[11] Patent Number: 5,641,314

[45] Date of Patent: Jun. 24, 1997

[54] MEMORY CARD RECEPTACLE CONNECTOR AND CONTACT TERMINAL

[75] Inventors: John L. Broschard, III, Hershey; Robert S. Correll, Jr., Harrisburg; Dennis Leroy Kemmick, Columbia; John T. Larkin, Jr., New Cumberland, all of Pa.

[73] Assignee: The Whitaker Corporation, Wilmington, Del.

[21] Appl. No.: 497,129

[22] Filed: Jun. 30, 1995

[51] Int. Cl.[6] ..... H01R 13/41

[52] U.S. Cl. ..... 439/751; 439/733.1

[58] Field of Search ..... 439/733.1, 751, 439/746, 747, 748, 749, 83

[56] References Cited

U.S. PATENT DOCUMENTS

| | | | |
|---|---|---|---|
| 3,665,378 | 5/1972 | Hammell et al. | 439/748 |
| 3,754,203 | 8/1973 | Pauza et al. | 439/71 |
| 4,066,326 | 1/1978 | Lovendusky | 439/873 |
| 4,443,053 | 4/1984 | Astbury | 439/751 |
| 4,516,188 | 5/1985 | Kessler | 439/83 |
| 4,583,807 | 4/1986 | Kaufman et al. | 439/83 |
| 4,717,354 | 1/1988 | McCleerey | 439/751 |
| 4,735,575 | 4/1988 | Shaffer | 439/82 |
| 4,748,841 | 6/1988 | Mezger et al. | 72/326 |
| 4,908,942 | 3/1990 | Long et al. | 29/882 |
| 4,975,066 | 12/1990 | Sucheski | 439/751 |
| 5,199,908 | 4/1993 | Sucheski | 439/751 |
| 5,252,094 | 10/1993 | Colleran et al. | 439/733 |
| 5,266,056 | 11/1993 | Baderschneider et al. | 439/746 |
| 5,288,247 | 2/1994 | Kaufman | 439/607 |
| 5,330,360 | 7/1994 | Marsh et al. | 439/76 |
| 5,337,220 | 8/1994 | Granitz | 361/816 |
| 5,338,210 | 8/1994 | Beckham et al. | 439/131 |

FOREIGN PATENT DOCUMENTS 1-129771 9/1989 Japan .

*Primary Examiner*—Gary F. Paumen
*Assistant Examiner*—T. C. Patel

[57] ABSTRACT

A PCMCIA receptacle connector 2 for use with a PCMCIA card includes a plurality of receptacle contact terminals 34 positioned in two rows of cavities 18 in a housing 12. Each of the cavities has two cavity sections 20, 28. Mating pin terminal are received through the first cavity section 20 and the contact terminals are inserted from the rear face 16 of the housing 12 into the second housing cavity 28, which has smooth interior walls 32. Each stamped and formed contact terminal 34 has a forward mating section 36, a central contact support section 48, and a rear conductor contact section 42 including surface mount solder tails 44. The contact support section 48 includes resilient spring members 50 in the form of edge stamped cantilever spring members that engage the interior smooth walls 32 of the second cavity section 28 to retain the contacts in the housing 12 and to properly position the mating contact section 36 and the solder tails 44.

24 Claims, 8 Drawing Sheets

MEMORY CARD RECEPTACLE CONNECTOR AND CONTACT TERMINAL

FIELD OF THE INVENTION

This invention relates to an electrical connector and contact terminals for use in that electrical connector. More specifically, this invention relates to an improved contact support configuration for securing and positioning a stamped and formed contact terminal in a cavity in an electrical connector housing. This invention is especially useful for PCMCIA receptacle connectors used on PCMCIA cards.

BACKGROUND OF THE INVENTION

The Personal Computer Memory Card International Association (PCMCIA) is an organization composed of a number of manufacturers of PC cards and related peripheral equipment. This organization has established standards or specifications for memory cards used with computers and especially for use with laptop, notebook or portable computers. PC cards which meet this PCMCIA standard are credit card-sized wafers. The dimensions of a PCMCIA standard card assembly are 85 mm. in length and 55 mm. wide. These cards employ a high density electrical connector to connect the PC card to the personal computer or other computing equipment with which the PCMCIA card is to be used. This high density electrical connector includes a number of sockets which mate with pins on the computer. This high density connector meets the requirements of the PC Card Standard, PCMCIA dated February 1995 which defines the PC Card's physical outline and the connector system qualification test parameters, including reliability, durability and environmental test parameters.

PCMCIA cards can be used with laptop or notebook personal computers to provide an interface to a peripheral device such as an external floppy disk drive. PCMCIA cards can also be used as memory cards, including Flash, EPROM, DRAM or as other memory cards. When used in these applications the PCMCIA cards are inserted into a card slot and into engagement with a standard high density connector mounted on a printed circuit board in the computer.

PCMCIA cards are not limited to use as memory cards or external floppy disk drives that have no external connection other than their connection to the computer. These cards can also be used as part of an external modem which is connected to an external telephone line or as part of a local area network interface assembly.

Standard PCMCIA cards or card assemblies do employ a standard electrical receptacle connector having two rows of contact terminals solder to a printed circuit board. Standard PCMCIA receptacle connectors have sixty eight terminals. PCMCIA cards typically the have a length and width substantially the same as a credit card, and the height of these cards, though greater than the thickness of a credit card, is relatively small. The receptacle connectors used on these cards are also relatively small. These small connectors each having a relatively large number of contact terminals, therefore, must include housings having relatively thin walls. One commercially available prior art connector employs terminals that are retained in the connector housing by a contact retention section having barbs or a Christmas tree configuration on each side of a flat central section of the contact terminal. These barbs or Christmas trees can dig into the walls of the housing and can lead to deformation or cracking of the housing. An improved retention, support and positioning section that would eliminate these problems and would result in simple, easily manufactured housing and terminal, therefore, is desirable.

There are some electrical connectors that do employ a contact retention member located on the upper edge of U-shaped sidewalls. For example, U.S. Pat. No. 3,665,378 discloses a stamped and formed contact that includes cantilever spring levers that engage the interior walls of a housing to position a contact. Those spring levers abut a rearwardly facing shoulder to prevent further insertion of the contact, but a separate tang is employed to prevent extraction. U.S. Pat. No. 4,717,354 discloses a solder cup connector having a U-shaped section with barbs located at the upper end of the U-shaped section that plough through the plastic during insertion and the plastic flows around the barbs to prevent retraction of the contact. However, neither of these prior art patents are directed to a contact terminal that can be used with a smooth cavity to retain the contact and to position mating and external connector contact sections in proper alignment with a small electrical connector such as a PCMCIA receptacle connector.

SUMMARY OF THE INVENTION

This invention encompasses both an electrical connector and a contact terminal employed in an electrical connector. The contact terminal is a stamped and formed electrical connector having a mating section, a conductor contact section and a contact support section. The preferred embodiment of the mating section includes spring contacts in a socket configuration for engaging a mating pin. The preferred embodiment of the conductor contact section comprises external surface mount solder tails that can be soldered to printed circuit board pads with the connector housing extending parallel to the printed circuit boards. The contact support section includes a resilient spring member that engages the walls of housing cavities in which the terminals are positioned. The preferred embodiment of this resilient spring member is a rearwardly facing cantilever spring having a sharp upper corner for engaging the top wall of the corresponding housing cavity. This resilient spring holds the mating section and the conductor contact section in proper alignment and retains the contact terminal in the housing.

The electrical connector has a plurality of housing cavities extending from a mating end to a rear end. Each cavity includes a first cavity section adjacent the mating end of the housing and a second cavity joins the first cavity section and is open on the rear housing end so that the contact terminals can be loaded into the cavities from the housing rear. The internal walls of the second cavity section are smooth and do not included any indentations, shoulders of side openings for retaining the contacts in the housing. The second cavity section, therefore, can be molded using a simple straight draw molding core pin simplifying the molding of small connectors having thin walls and relatively close centerlines. The contact terminals having resilient spring member that deflect primarily in the plane of the resilient spring can be used to hold the contacts in the cavities with smooth internal walls. Contact terminals with rigid barbs instead of resilient spring retention members can be used in other embodiments of this invention.

The preferred embodiment of this invention is intended for use in an electrical connector for use on a PCMCIA card and conforms dimensionally and in other aspects to the requirements of the PCMCIA standard in effect as of the filing date of this application.

DETAILED DESCRIPTION OF THE PREFERRED EMBODIMENT

Figure 1:
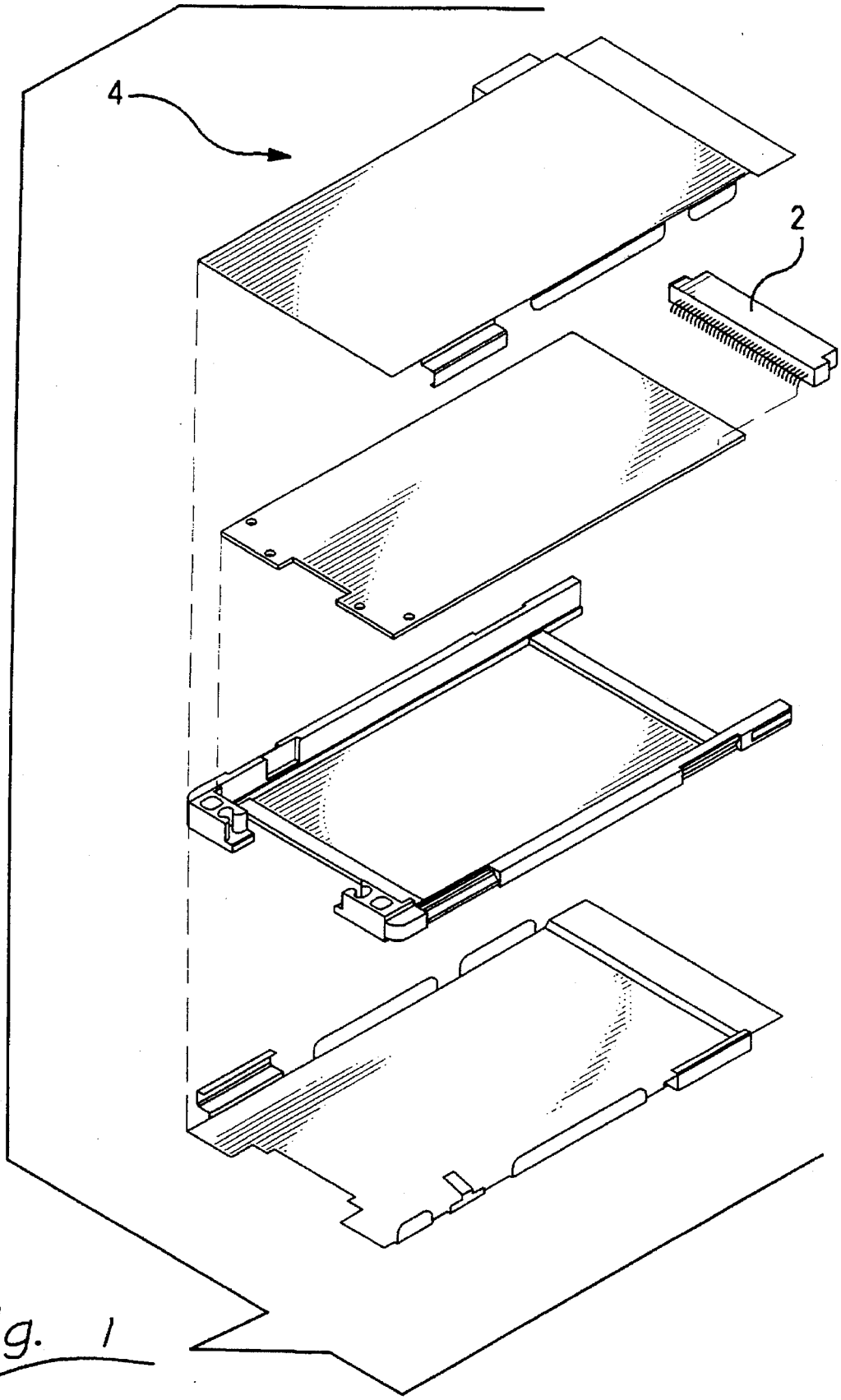
FIG. 1 is a view of a PCMCIA card and the receptacle connector used on a PCMCIA card to connect the card to the pins in a mating header in a PCMCIA slot on a computer.

FIG. 1 shows the basic elements of a PCMCIA card assembly or frame kit complying with the PCMCIA Open System Standard. The heart of the PCMCIA card assembly 4 is a PCMCIA card or memory card 4. This card is a printed circuit board. Circuit elements or components used for storing, receiving, transmitting or other standard data processing or manipulation are mounted on this printed circuit board. For example, this PCMCIA card can contain all of the circuit elements necessary to implement a modem, or it can comprise a network interface card. The specific components to be mounted on this card or printed circuit board are not shown, since the specific circuits are not relevant to the input/output connector that is the subject of the invention disclosed herein. The PCMCIA card assembly also includes a top cover and a bottom cover. This PCMCIA card assembly 4 is approximately 85 mm. long and 55 mm. wide.

PCMCIA card assembly 4 has a socket or receptacle connector 2 is located at one end. This receptacle connector 2 includes socket terminals which mate with pins protruding into a card slot on a computer when the PCMCIA card assembly 4 is mated with a computer. This card and receptacle connector comply with the PCMCIA Open System Standard or PC Card Standard bearing a release date of February 1995. Furthermore the receptacle connector assembly can be used with either Type I or Type II PCMCIA cards.

Figure 2:
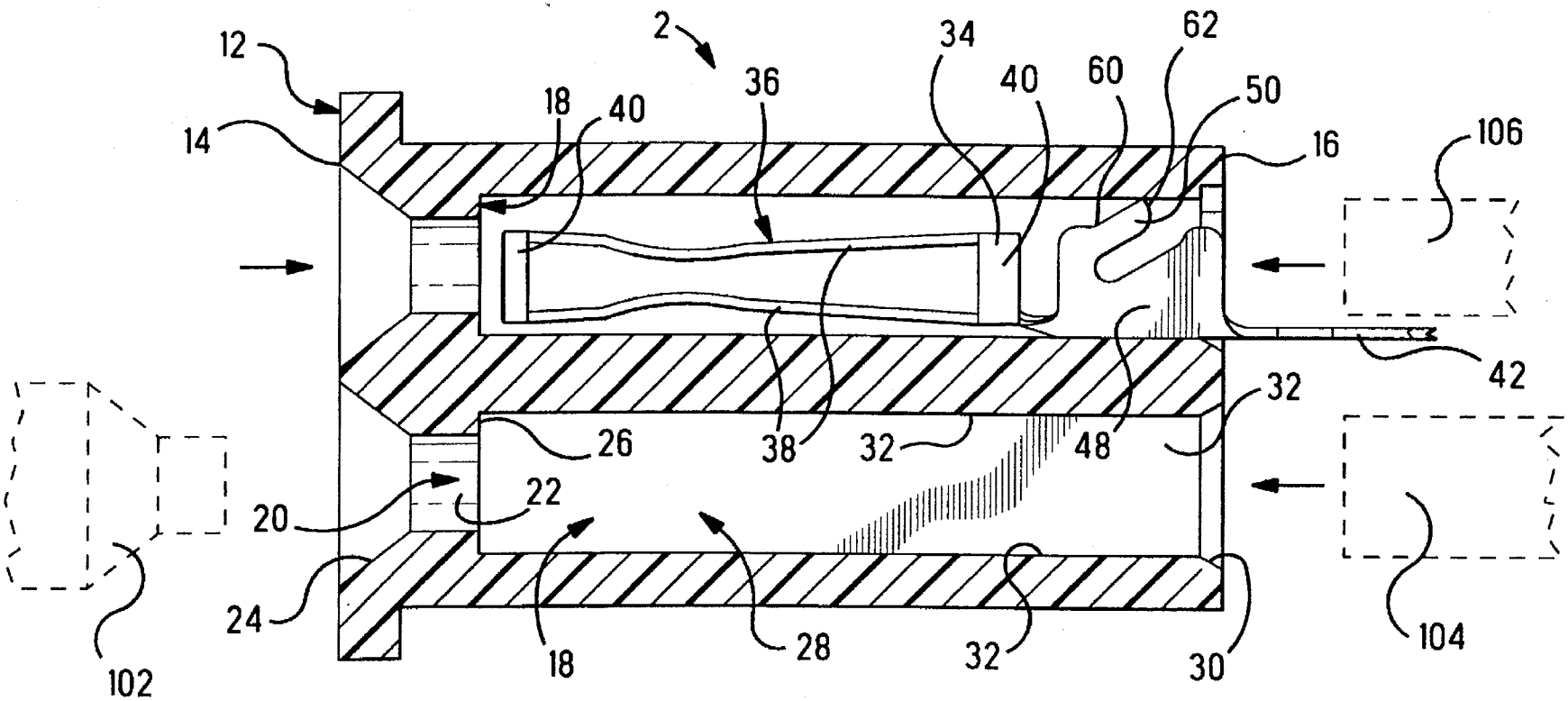
FIG. 2 is a view of the receptacle connector shown in FIG. 1 showing the connector housing in section and showing one contact terminal in a cavity in one row of the connector with the cavity is a second row remaining empty. Core pins used to mold the cavities and an insertion tool used to insert the contact terminals into the housing are shown in phantom.
Figure 4:
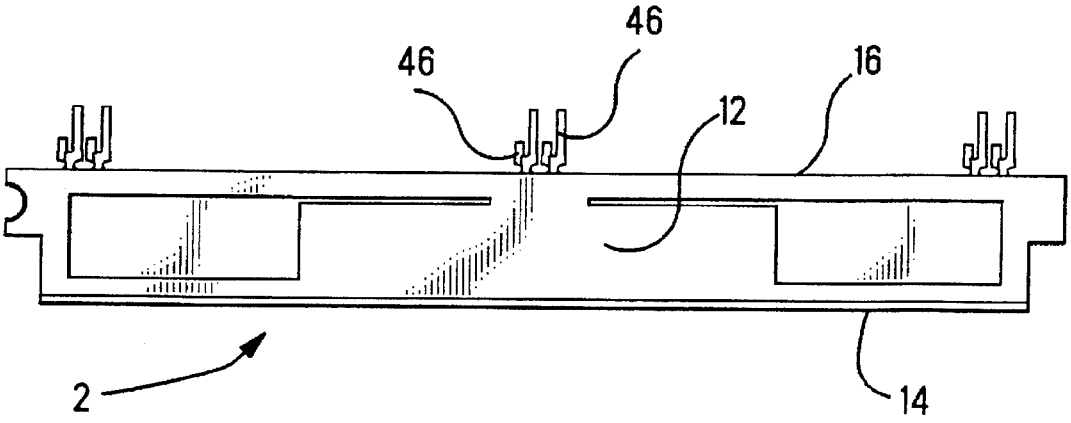
FIG. 4 is a top plan view of the receptacle connector.
Figure 3:
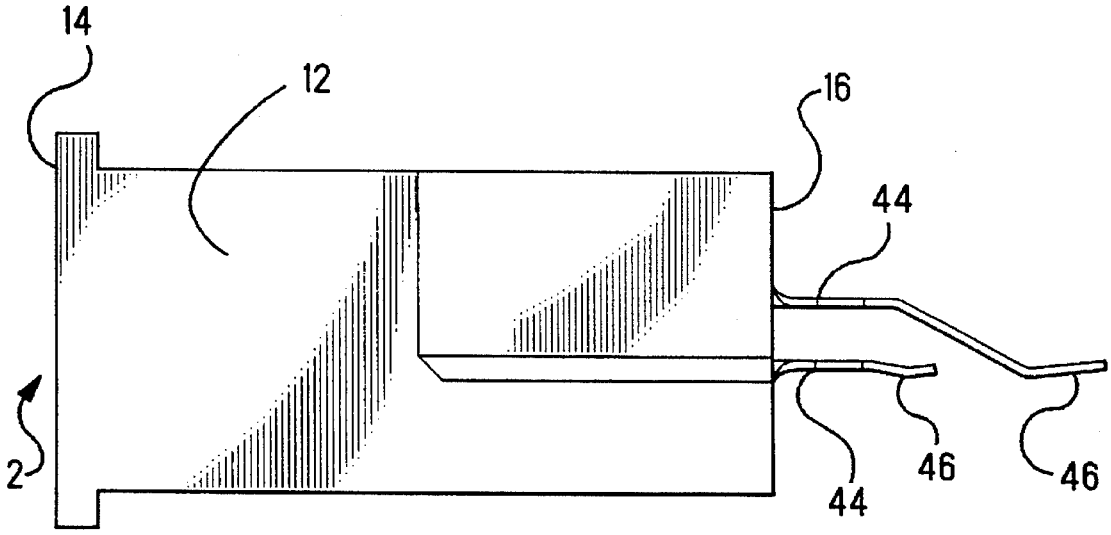
FIG. 3 is a side view of the receptacle connector shown in FIG. 2 showing the surface mount solder leads extending from the rear of the connector housing.
Figure 5:
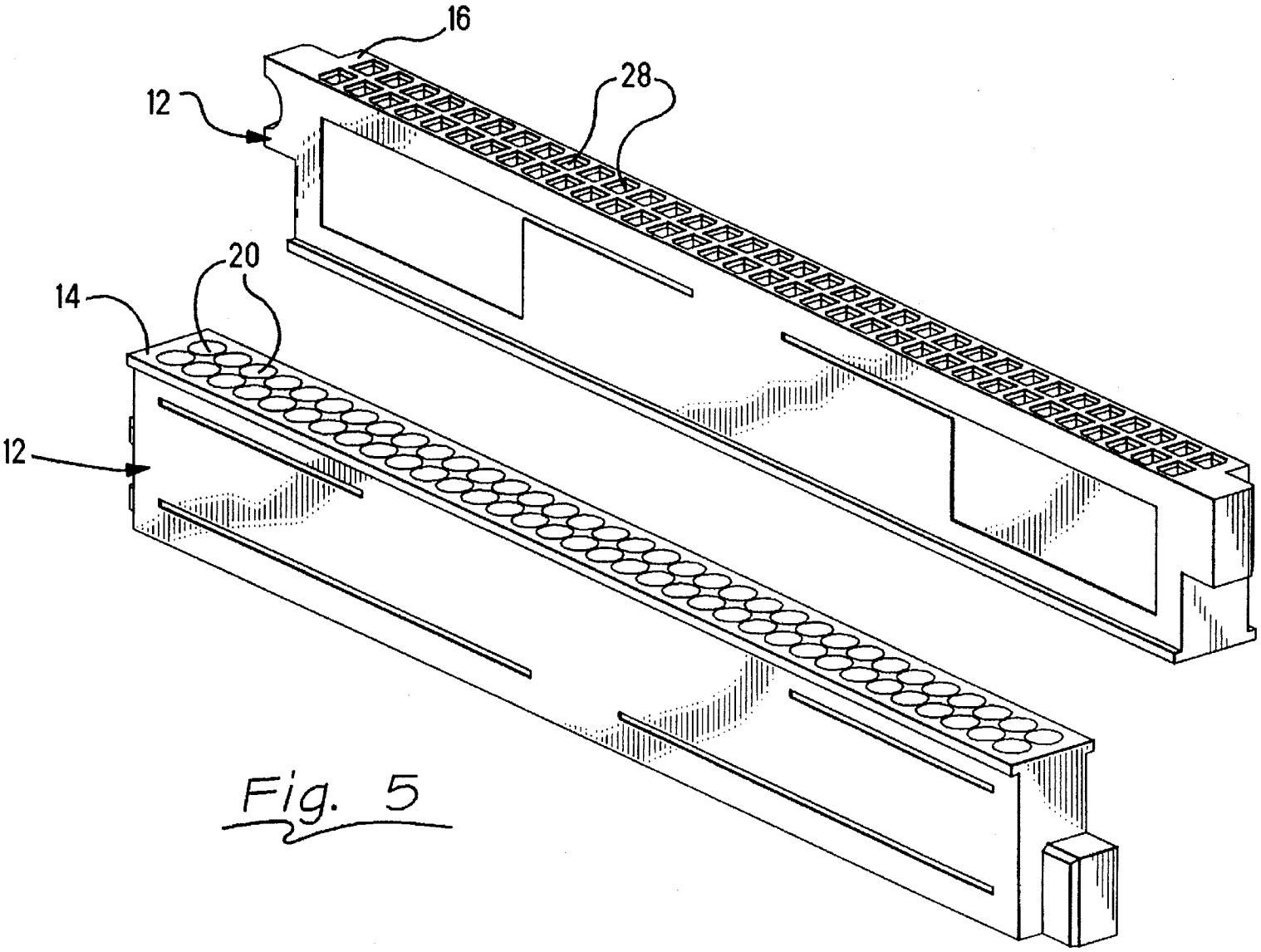
FIG. 5 is a perspective view of the connector housing showing two different views of the same housing to depict the mating and rear faces of the housing.

FIG. 2–4 show receptacle connector 2 that includes a connector housing 12 having a plurality of housing cavities 18 in which stamped and formed contact terminals 34 are located. Housing cavities 18 and contact terminals 34 are located in two rows, and each cavity extends between a mating housing face 14 and a rear housing face 16. In accordance with the PCMCIA standard, sixty eight terminals are located in two rows of thirty four terminals each. Representative dimensions for the receptacle connector 2 are 1.746 inches wide (1.870 including mounting ears), 0.106 inches high (0.130 including forward flange), and 0.236 inches deep. Adjacent contacts are spaced apart on centerlines of 0.50 inches. Representative wall thicknesses of the housing walls forming the cavities 18 are on the order of 0.022 inches.

Figure 6:
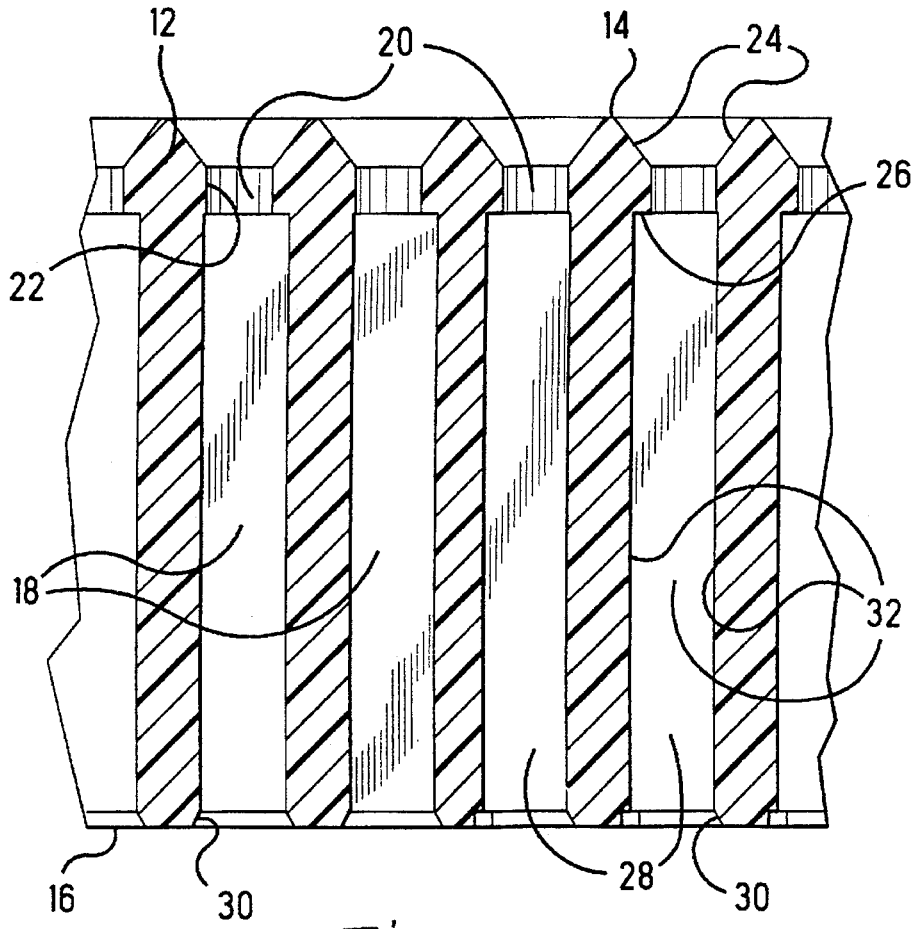
FIG. 6 is a section view taken along section lines 6—6 in FIG. 8 showing the housing cavities in which contact terminals are inserted.
Figure 7:
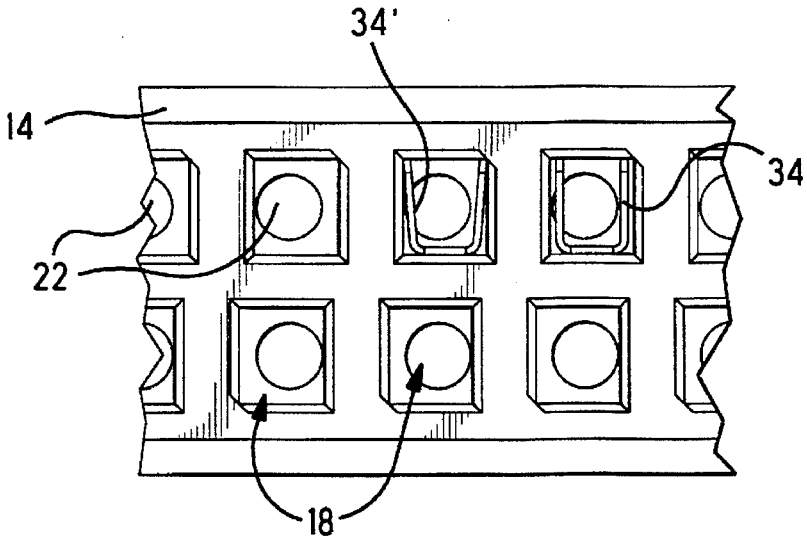
FIG. 7 is a view of a portion of the rear face of the housing showing the offset between the second cavity sections in the two cavity rows at the rear of the housing.
Figure 8:
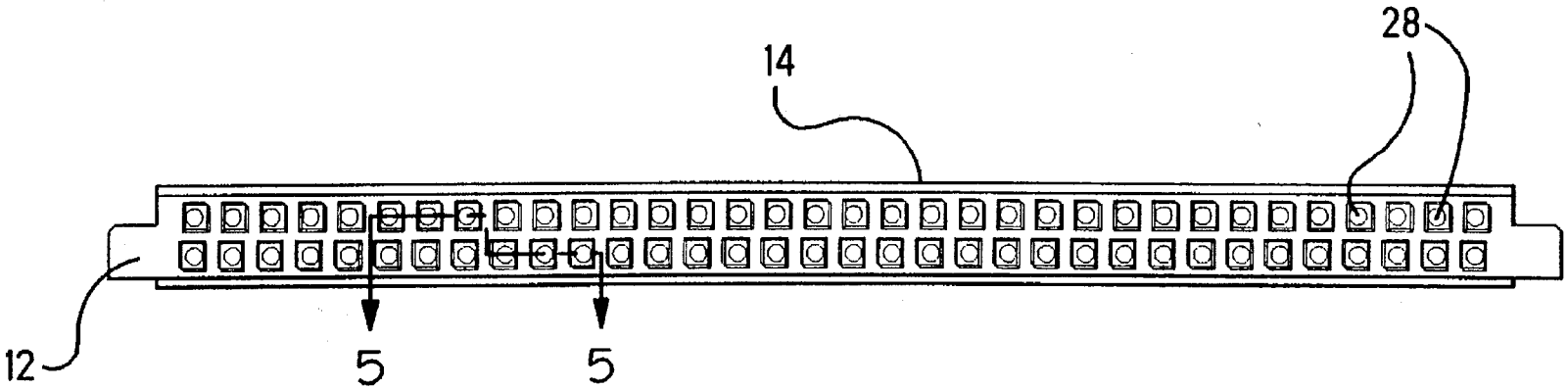
FIG. 8 is a rear view of the housing.
Figure 9:
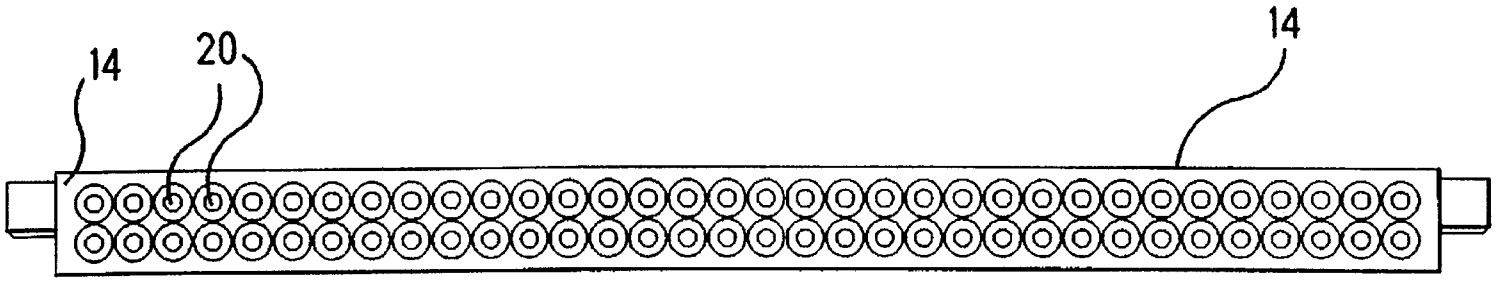
FIG. 9 is a front view of the housing.
Figure 10:
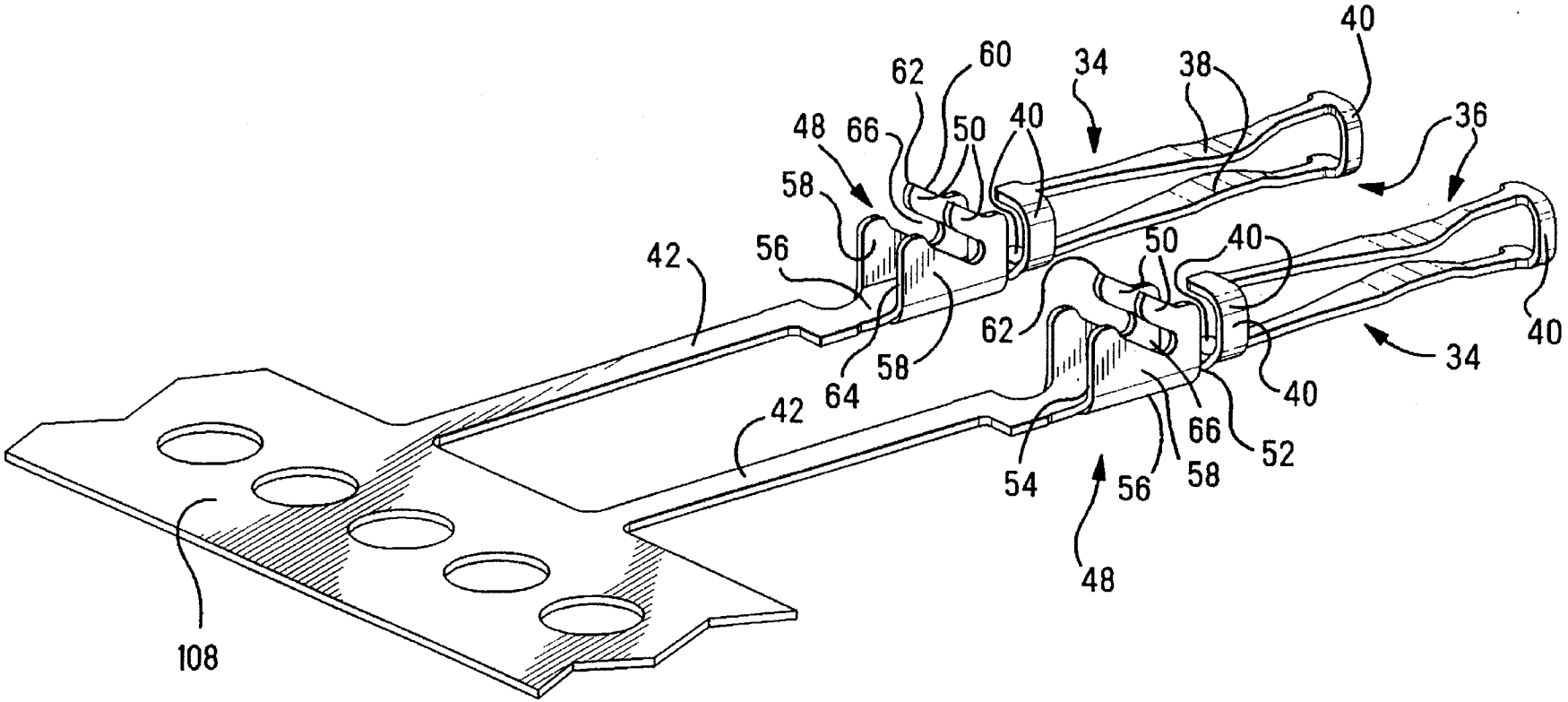
FIG. 10 is a perspective view showing two stamped and formed contact terminals on a common carrier strip.
Figure 13:
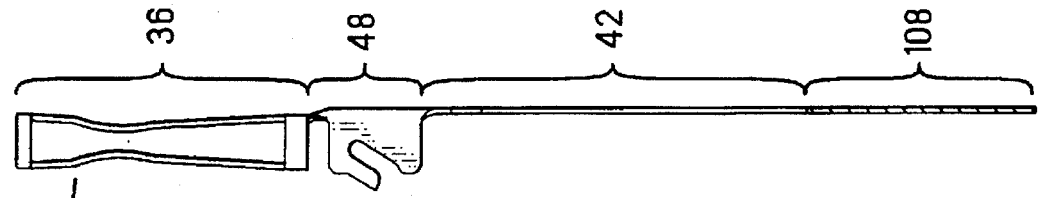
FIG. 13 is a side view of one contact terminals showing the sections of the terminal.
Figure 12:
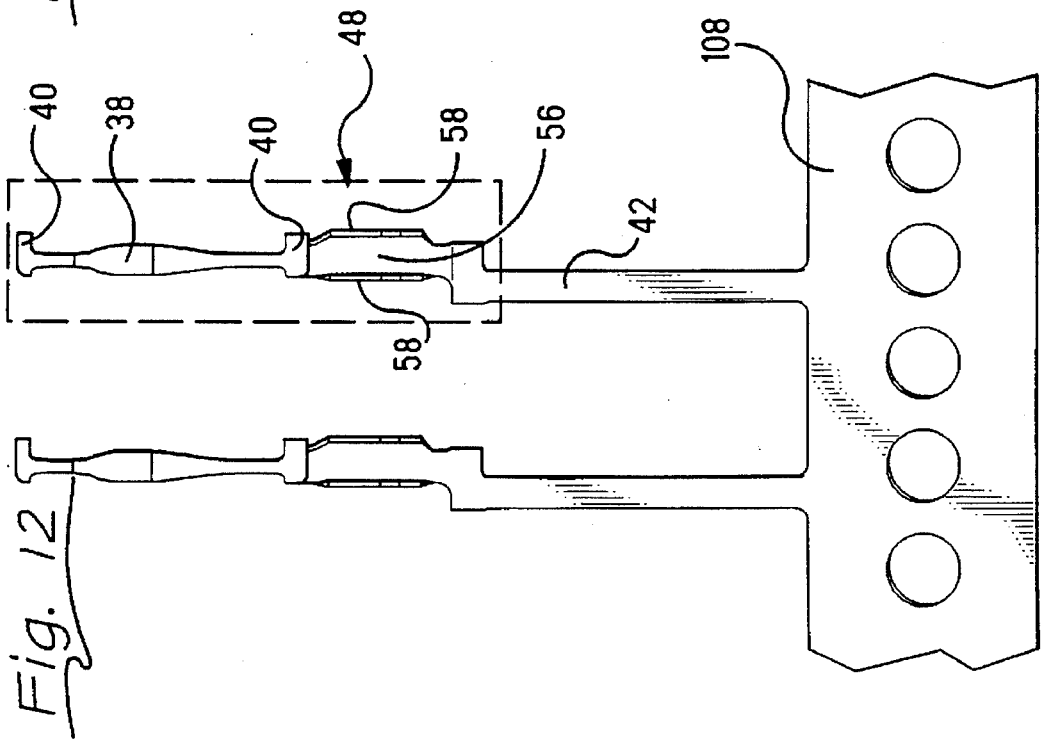
FIG. 12 is a top view of the two formed terminals. The portion of the formed terminal corresponding to the blanked portion shown in FIG. 11 is enclosed by the dashed lines.
Figure 11:
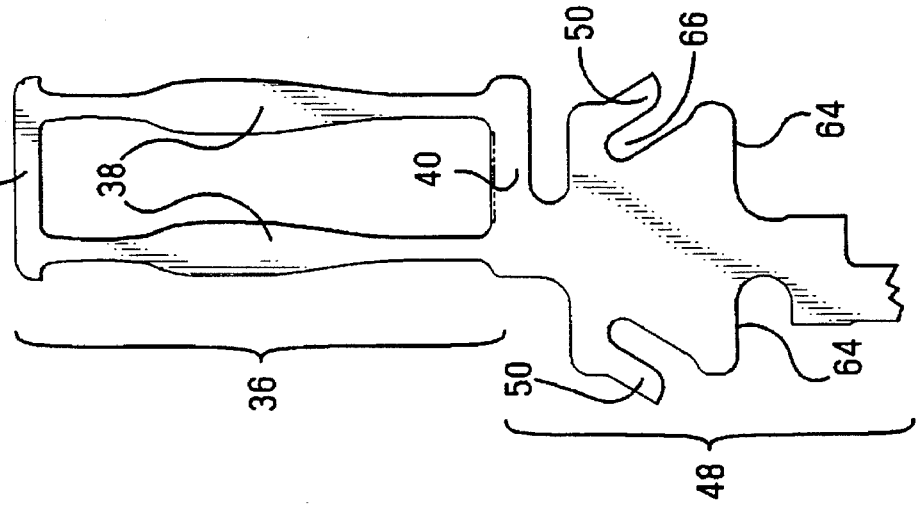
FIG. 11 is a view of the blank stamping for one of the terminals shown in FIG. 10 prior to forming the terminal.

FIG. 2 shows a single contact terminal 34 located in one housing cavity 18 in one row and an empty cavity 18 in the same corresponding position of the other row in the standard two row connector. Each housing cavity 18 has two sections. The first section 20 extends into the housing 12 from the front or mating face 14. A second cavity section 28 extends into the housing 12 from the rear face 16. The second cavity section 28 joins the first cavity section 20 adjacent the housing mating face 14. The housing 12 is molded from an conventional engineering plastic such as a liquid crystal polymer. Each cavity is formed by molding core pins that are retracted form the mold in opposite directions along the same axis. These molding pins are shown in phantom in FIG. 2. A first molding core pin 102 forms the first cavity section 20 and a second molding core pin 104 forms the second cavity section 28. The first cavity section 20 includes a circular opening 22 formed by a cylindrical section of the core pin 102. A beveled lead in section 24 is located between the circular opening 22 and the front face of the housing 12 and is formed by a conical section on the core pin 102. The second cavity section 28 has a generally rectangular cross section and the second cavity section is defined by four cavity walls 32. This second cavity section 28 is formed by a the generally rectangular core pin 104 and this second cavity section has a generally smooth constant cross section, with the exception of the short lead in section 30, between the rear housing face 16 and the first cavity section 20. The second cavity section 28 does not include any protrusions, indentations or side entries or discontinuities. The second cavity section 28 has a larger inner dimension than the first cavity opening 22 and a rearwardly facing shoulder 26 is located at the intersection of the first cavity section 20 and the second cavity section 28. FIG. 7 shows that the openings 22 in the first cavity section 20 are slightly offset relative to the centerline of the rectangular second cavity sections 28 and that the second cavity sections 28 are offset in the two rows of this connector. FIGS. 6 and 7 also show that the lead in 30 on the rear of the second cavity section is also not uniform around the periphery of the second cavity section 28.

The contact terminals 34 positioned in the housing cavities 18 are stamped and formed from a material such as phosphor bronze. Each contact terminal has a mating section 36 at the front of the terminal, a conductor contact section 42 at the rear of the terminal and a central contact support section 48. The mating section 36 and the contact support section 48 are positioned in the second cavity section 28. The conductor contact section 42 comprises a solder tail 44 that extends from the rear of the receptacle connector housing 12. Each contact terminal 34 is inserted into the corresponding cavity 18 from the rear of the housing 12. An insertion tool 106 is shown in phantom in FIG. 2.

The mating section 36 of each contact terminal 34 includes two opposed contact springs 38 that are joined at each end by transversely extending straps 40. Each contact spring 38 is inwardly formed so that the contact point is located between the two straps 40. When a pin on a mating connector is inserted into the corresponding housing cavity 18 through the mating face 14 and through the opening 22, the two contact springs are expanded and a pressure contact is formed by the contact springs 38 with the corresponding pin.

The terminal conductor contact section 42 includes a surface mount solder tail 44 with a surface mount pad 46 located at the end of the contact terminal. As shown in FIGS. 3 and 4 the configuration of the solder tails 44 on contact terminals in each row is different. The upper row of terminals in FIG. 3 have a longer solder tail than the terminals in the lower row so that the location of the solder pads 46 are offset in two rows. The solder tails in the two rows are also staggered as seen in FIG. 4. This staggered, offset, two row configuration is because there is a minimum spacing between adjacent solder pads on the printed circuit board for reliable surface mount soldering of the connector to the board.

The contact support section 48 positions the mating section 36 in alignment with the opening 22 in the first cavity section 20, it positions the solder tail pads 46 on both rows of contact terminals 34 in a common plane for soldering, and it retains the contact terminals 34 in the second cavity section 28 with its smooth interior walls 32. The preferred embodiment of this contact support section 48 is U-shaped formed by a flat contact support base 56 and two spaced sidewalls 58 that extend upward from the opposite edges of the base 56. The front edge 52 of each sidewall is located adjacent to the mating contact section 36 and the rear sidewall edge 64 is located adjacent to the solder tails 44 in the conductor contact section. These rear sidewall edges 64 are flat and are flush with the rear housing face 16. These rear sidewall edges 64 provide a surface engaged by an insertion tool 106 and when these edges 64 are flush with the rear of the housing when the contact terminal 34 is fully inserted into the corresponding cavity 18. Each sidewall 58 includes a resilient edge stamped spring member 50 at the upper edge of the sidewall 58. Each spring member 50 is a cantilever beam extending from the front of the sidewall 58 toward the conductor contact section 42 at the rear of the terminal. The cantilever beam spring member 50 is formed by a slot 66 stamped into each sidewall 58. The upper edge 60 of each spring member 50 terminates in a sharp corner 62. This sharp corner 62 is located at the upper rear of the spring member 50 and forms the highest portion of the contact support section 48 and the contact terminal 34. This sharp corner 62 engages the upper interior wall 32 of the second cavity section 28 when the contact terminal 34 is inserted. The cantilever spring member 50 deflects about the base of the spring member adjacent the front of the contact support section 48. This spring member 50 deflects in the plane of the sidewall. Since the cantilever spring member 50 faces rearward, the sharp corner 62 will engage the smooth inner wall of the second cavity section 28 so that the sharp corner will tend gouge the inner cavity wall if the terminal is moved rearward due to an extraction force or due to the force exerted on the terminal during insertion of a mating pin. The resilient spring member 50 also forces the base 56 of the contact support section 48 into engagement with the bottom wall 32 of the second cavity section 28 to precisely position the contact terminal 34 relative to the housing 12. The mating section is aligned, therefore, with the first cavity opening 22 and the solder tails 44 are properly aligned end to end and axially with the surface mount solder pads 46 positioned in the same plane so that they can subsequently be soldered to the pads on the printed circuit board in the PCMCIA card assembly. Since the spring member 50 is edge stamped, it must deflect about an axis perpendicular to the sidewall and this spring member will be stiffer than a spring that deflects about an axis in the plane of the sidewall. This edge stamped, cantilever beam spring member thus positions and secures the terminal 34 in a corresponding cavity 18 without the need for a molded surface in the housing. A simpler molded housing, therefore, is possible. This simplicity is of added importance for small electrical connectors containing a relatively large number of terminals on closely spaced centerlines.

Although the preferred embodiment of this invention is intended for use on receptacle connectors specifically intended for use with PCMCIA cards, the resilient spring members used in the contact support section are not limited to that one application. These resilient spring members can be used with other contact terminal configurations and with other connector configurations. For example, this resilient spring contact support configuration could be used on male or pin terminals instead of contact terminals having a female receptacle mating section. Pin or receptacle terminals with the resilient spring can also be used with other housing configurations and would be especially useful on small connectors with relatively thin housing walls and closely spaced contact centerline spacings.

Although the preferred embodiment of this invention employs a U-shaped contact support configuration in which the sidewalls containing the resilient spring member are parallel, such a configuration is not essential. For example, a V-shaped configuration, in which the sidewalls diverged, could also be employed. An alternate contact 34' with a V-shaped contact support configuration is shown in FIG. 7 where it is compared to a contact 34 with a U-shaped contact support configuration. A contact having a flat base with diverging sidewall instead of parallel sidewall has at least one advantage over a U-shaped contact. The diverging sidewalls can engage the side surfaces of the housing cavity or the juncture of the side and top of the cavity and center the contact between the sides. By centering the contact relative to the centerline of the housing cavity, the position and alignment of the solder tails can more precisely controlled. Indeed a contact support section having only one resilient spring member could be employed.

Although there are advantages to employing the resilient spring member in the contact support section, this invention is not so limited. Contact support members having a rigid barbed upper edge would comprise a broader embodiment of this invention. Preferably these rigid barbs in the alternate configuration would not dig into the housing walls, but would impart a slight resilient deformation to the housing walls.

These and other embodiment suggested to one of ordinary skill in the art by this disclosure would be within the scope of one or more of the following claims.

We claim:

1. An electrical connector comprising:

a housing having a plurality of cavities:

a plurality of stamped and formed contact terminals, each terminal being positioned in a corresponding cavity in the housing, each terminal including a mating section for engaging a mating terminal inserted into the corresponding cavity and a conductor contact section for establishing an electrical connection to a corresponding electrical conductor, each terminal also including a contact support section located between the mating section and the conductor contact section, each contact support section including two spaced generally planar sidewalls coextending from a base wall, each having a resilient spring member extending in the plane of the respective sidewall and angled to extend away from the base wall and in a direction opposed to the insertion direction to a free end engageable with an internal wall of the corresponding cavity to support and secure the terminal in the corresponding cavity;

each resilient spring member adapted to be deflectable in the plane of the respective sidewall so that the resilient spring member engages said internal wall and deflects during insertion of terminal into respective cavity and upon full insertion of said terminal, said spring member thereafter exerts a force against the internal wall of the corresponding cavity to position the terminal in the corresponding cavity and to resist extraction from the housing.

2. The electrical connector of claim 1 wherein each resilient spring member comprises a cantilever beam extending from the front of the contact support section, adjacent the mating section, towards the rear of the contact support section, adjacent the conductor contact section.

3. The electrical connector of claim 1 wherein the conductor contact section comprises a solder tail and the mating section includes means for establishing a removable pressure contact with the mating terminal.

4. The electrical connector of claim 1 wherein the rear of the contact support section comprises a flat edge spaced from the resilient contact member and extending in the same plane as the resilient contact member, the flat edge being positioned at a rear open face of the corresponding cavity, the flat edge comprising a surface engagable with an insertion tool so that each terminal can be inserted into the corresponding cavity from the rear thereof and positioned therein.

5. The electrical connector of claim 1 wherein each resilient spring member is formed from a flat section of the contact support section, each spring member being defined by a slot stamped in the flat section, with the spring member extending upwardly from the flat section at an angle above the slot.

6. The electrical connector of claim 5 wherein each resilient spring member extends to a sharp corner at the uppermost edge thereof, the sharp corner engaging a wall of the corresponding cavity to bias the terminal towards an opposite cavity wall and to resist retraction of the terminal from the corresponding cavity.

7. The electrical connector of claim 1 wherein the conductor support section positions both the mating section and the conductor contact section relative to the housing.

8. The electrical connector of claim 7 wherein the conductor contact section comprises a surface mount solder tail, and the resilient spring member maintains the true position and coplanarity of the surface mount solder tail.

9. An electrical connector comprising a housing and a plurality of stamped and formed contact terminals;

the housing having a plurality of cavities communicating between a mating face and a rearward face of the housing, each cavity having two sections, the first cavity section extending inwardly from the mating face and including an opening for positioning a mating terminal inserted therethrough into engagement with a corresponding contact terminal, the second cavity section extending inwardly from the rear face of the housing and being formed by a molding core pin having a constant cross section so that the second cavity section has a smooth periphery without protrusions, indentations or side entries, the second cavity section joining the first cavity section between the faces of the housing;

each contact terminal having a mating section, a conductor contact section protruding from the rear face of the housing, and a contact support section located in the second cavity section of the corresponding cavity, each contact support section including two spaced generally planar sidewalls coextending from a base wall, each having a resilient spring member extending in the plane of the respective sidewall and angled to extend away from the base wall and in a direction opposed to the insertion direction to a free end engageable with an internal wall of the corresponding cavity to support and secure the terminal in the corresponding cavity;

each resilient spring member adapted to be deflectable in the plane of the respective sidewall so that the spring member engages the inner periphery and deflects during insertion of the terminal into the corresponding cavity and said spring member thereafter engages and exerts a force against the smooth inner periphery of the second cavity section to retain the contact terminal in the corresponding cavity, to position the mating section in alignment with the first cavity section and to position the conductor contact section for attachment to external conductor means.

10. The electrical connector of claim 9 wherein the base and sidewalls of the contact support section comprise a U-shaped section having a flat base.

11. The electrical connector of claim 9 wherein the resilient spring member comprises a cantilever spring member.

12. The electrical connector of claim 9 wherein the first cavity section has an opening having a smaller height than the second cavity section, the contact support section aligning the mating section of the contact terminal with the smaller opening in the first cavity section.

13. The electrical connector of claim 9 wherein the conductor contact section comprises a solder tail.

14. The electrical connector of claim 9 wherein the second cavity section has a rectangular cross section.

15. The electrical connector of claim 14 wherein the rectangular cross section of the second cavity section is continuous and uninterrupted from the rear face of the housing to the first cavity section.

16. The electrical connector of claim 15 wherein a rearwardly facing shoulder is formed between the first cavity section and the second cavity section.

17. The electrical connector of claim 9 wherein the housing includes multiple rows of side by side cavities.

18. The electrical connector of claim 17 wherein the contact support section has a flat base with diverging sidewalls.

19. The electrical connector of claim 17 wherein the housing has two rows of cavities and the first cavity sections are in alignment in each row and with the corresponding first cavity section of the corresponding cavity in the other row, the second cavity sections being offset from the corresponding cavity in the other row.

20. The electrical connector of claim 17 wherein the contact support section of each terminal comprises a U-shaped member, the U-shaped contact support sections of each terminal facing in the same direction.

21. The electrical connector of claim 20 wherein the U-shaped contact support sections facing in a direction extending transverse to the rows of cavities.

22. A receptacle connector for use on a PCMCIA card to connect the PCMCIA card with a mating header in a PCMCIA slot on a computer, the receptacle connector comprising:

a housing having two rows of cavities, the housing having a height not in excess of the height prescribed for PCMCIA cards;

a plurality of contact terminals positioned in the cavities in the housing, each contact terminal having a solder tail for attaching the terminals to the PCMCIA card with the terminals extending parallel to the card and a mating section for engaging mating pins in the mating header in the PCMCIA slot;

each contact terminal including a conductor support section between the mating section of each terminal and the solder tail, said support section including two spaced generally planar sidewalls coextending from a base wall, each having an edge stamped resilient spring member extending in the plane of the respective sidewall and angled to extend away from the base wall and in a direction opposed to the insertion direction to a free end, said spring member being adapted to be deflectable in the plane of the respective sidewall during insertion of the terminal into the corresponding cavity, said free end being engageable with the inner wall of the corresponding cavity to retain the terminal therein and to position the mating contact sections and the solder tails in rows for attachment to corresponding pins and to the card respectively.

23. The receptacle connector of claim 22 wherein the solder tails comprise surface mount solder tails.

24. The receptacle connector of claim 23 wherein the solder tails in a first row of contact terminals are longer than the solder tails in a second row of contact terminals.

* * * * *